US005228841A

United States Patent [19]

Kimura et al.

[11] Patent Number: 5,228,841

[45] Date of Patent: Jul. 20, 1993

[54] VARIABLE CAPACITY SINGLE HEADED PISTON SWASH PLATE TYPE COMPRESSOR HAVING PISTON ABRASION PREVENTING MEANS

[75] Inventors: Kazuya Kimura; Hiroaki Kayukawa, both of Kariya, Japan

[73] Assignee: Kabushiki Kaisha Toyoda Jidoshokki Seisakusho, Kariya, Japan

[21] Appl. No.: 855,711

[22] Filed: Mar. 20, 1992

[30] Foreign Application Priority Data

Mar. 28, 1991 [JP] Japan ..... 3-64434
Mar. 30, 1991 [JP] Japan ..... 3-20279[U]

[51] Int. Cl.[5] ..... F04B 1/26

[52] U.S. Cl. ..... 417/222.2; 417/269; 417/270; 92/12.2

[58] Field of Search ..... 92/71, 122; 74/60; 417/222 S, 269, 270; 123/58 BB

[56] References Cited

U.S. PATENT DOCUMENTS 1,430,275 9/1922 Almen ..... 74/60
1,517,386 12/1924 Almen ..... 74/60
1,826,325 10/1931 Paul ..... 123/58 BB
2,570,843 10/1951 Orshansky, Jr. ..... 92/12.2 X
4,432,702 2/1984 Honzawa et al. ..... 417/269
4,664,604 5/1987 Terauchi ..... 417/222 S

FOREIGN PATENT DOCUMENTS 60-175783 9/1985 Japan .

*Primary Examiner*—Richard E. Gluck
*Attorney, Agent, or Firm*—Brooks Haidt Haffner & Delahunty

[57] ABSTRACT

A variable capacity single headed piston, swash plate type compressor provided with a rotation-to-reciprocation conversion mechanism having a swash plate rotated by a drive shaft and formed with annularly extended engaged portions on opposite faces thereof, a pair of shoes located between the swash plate and each of the single headed pistons, each shoe having formed therein an engaging portion circumferentially slidably engaged with one of the annular engaged portions of the swash plate, and a spherical face to be in a displaceable and turnable contact with a cylindrical support wall of a radial recess of each piston and permitting a passage of the swash plate during the rotation thereof. The engagement and contact of the shoes with the swash plate and the pistons provide the respective pistons with an accurate and stable axial support, to thereby prevent a local abrasion of the single headed pistons.

6 Claims, 9 Drawing Sheets

VARIABLE CAPACITY SINGLE HEADED PISTON SWASH PLATE TYPE COMPRESSOR HAVING PISTON ABRASION PREVENTING MEANS

BACKGROUND OF THE INVENTION

1. Field of the Invention

The present invention relates to a variable capacity single headed piston-swash plate type refrigerant compressor mainly used for an air-conditioner for a car. More particularly, it relates to a variable capacity single headed piston-swash plate type compressor provided with a motion converting mechanism for converting a rotation of the swash plate into a reciprocation of the single headed pistons and effectively preventing a local abrasion of the reciprocating pistons and/or cylinder bores of the compressor to thereby obtain a reliable and long-life compression operation of the variable capacity compressor.

2. Description of the Related Art

A typical conventional variable capacity single headed piston-swash plate type compressor is disclosed in Japanese Unexamined ( Kokai ) Patent publication No. 60-175783 published on Sep. 9, 1985, by the Japanese Patent Office, whose corresponding U.S. Pat. No. 4,664,604.

FIG. 8 illustrates a compressor corresponding to the compressor of this publication. The compressor of FIG. 8 has a cylinder block 82 encased in a cylindrical shell 80, and provided with a plurality of cylinder bores 81. The cylindrical shell 80 defines a closed crank chamber 83 therein located axially in front of an inner end of the cylinder block 82. The crank chamber 83 is closed by a front housing 84 holding a radial bearing to support an outer portion Of a drive shaft 89. Rear ends of the cylinder block 82 and the cylindrical shell 80 are commonly closed by a rear housing 86 via a valve plate 85. The rear housing 86 is provided with an annularly extended suction chamber 87, and a cylindrical discharge chamber 88 communicated with the plurality of cylinder bores 81 of the cylinder block 82. The cylinder block 82 is centrally formed with a shaft bore in which a radial bearing is seated to rotatably support an inner end of the shaft 89. The drive shaft 89 has a central portion thereof on which a rotary support 90 is mounted to be rotated with the shaft 89 about the axis of the drive shaft 89 within the crank chamber 83. The rotary support 90 is connected with a swash plate 93 via a hinge mechanism 91, which includes an elongated aperture 91*a* formed in the rotary support 90, and a hinge pin 93*b* fixed to a swing plate 93*a* to be engaged in the elongated aperture 91*a*; The swing plate 93*a* is projected from a front face 93*d* of the swash plate 93, a rear face 93*c* of which faces an inner end of the cylinder block 82. As shown in FIG. 9, the swash plate 93 is slidably mounted on a spherical sleeve element 92 axially slidably mounted on the drive shaft 89. Namely, the swash plate 93 can be rotated together with the drive shaft 89 and slide on the spherical sleeve element 92 to change an angle of inclination with respect to a plate vertical to the drive shaft 89. The swash plate 93 is engaged with each of pistons 94 slidably fitted in the cylinder bores 81, via a pair of shoes 95 having a half-sphere shape. Each of the pair of shoes 95 has a flat face 95*a* engaged with the front or rear face 93*d* or 93*c* of the swash plate 93 and a spherical portion 95*b* slidably engaged with a spherical recess 94*a* formed in a frontmost portion of the piston, as shown in FIG. 9.

The cylinder block 82 is provided with a passageway 96 for providing a fluid communication between the crank chamber 83 and the suction chamber 87, and the passageway 96 can be closed and opened by a control valve 97.

When the drive shaft 89 is rotated by a drive force such as a force given by a car engine, the swash plate 93 is rotated together, and the pistons 94 are driven to perform a reciprocating movement in the cylinder bores 81. Namely, the rotation of the swash plate 93 is converted to a reciprocatory sliding movement of the piston 94 in the cylinder bore 81 by the pair of shoes 95 performing a complicated movement between the swash plate 93 and the piston 94. Namely, during the rotation of the swash plate 93, each shoe 95 slides, at the flat face 95*a* thereof, on the front or rear face 93*d* or 93*c* of the swash plate 93 along an ellipsoidal locus, and turns, at the spherical portion 95*b* thereof, in the spherical recess 94*a* of the piston 94 about the center of the spherical recess 94*a* of the piston 94. The sliding movement of the shoe 95 taking the ellipsoidal locus includes a first circumferential sliding movement relative to a plane lying in the front or rear face 93*d* or 93*c* of the swash plate 93, indicated by an arrow "A" in FIG. 9, and a second radial sliding movement relative to the same plate, indicated by an arrow "C" in FIG. 9. The rotating movement of the shoe 95 in the spherical recess 94*a* of the piston 94 is indicated by an arrow "B". The combination of the sliding and rotating movements of the shoe 95 contributes to the conversion of the rotation of the swash plate 93 into the reciprocation of each piston 94, and thus the reciprocation of the respective pistons 94 compresses a refrigerant gas pumped from the suction chamber 87 into the cylinder bores 81, and delivers the compressed refrigerant gas from the cylinder bores 81 toward the discharge chamber 88, from which the compressed refrigerant gas is further discharged toward an air-conditioning or refrigerating circuit.

The entire amount of the refrigerant gas discharged from the compressor, i.e., the whole compression capacity of the compressor, is controlled by adjusting a pressure level in the crank chamber 83 due to controlling operation of a capacity control valve 97.

When the capacity control valve 97 is moved to a position establishing a fluid communication between the crank chamber 83 and the suction chamber 87 via the passageway 96, the pressure level in the crank chamber 83 acting as a back pressure against the pistons 94 is lowered, and thus the angle of inclination of the swash plate 93 is made larger. Consequently, the hinge pin 93*b* of the hinge mechanism 91 is moved in the elongated aperture 91*a* to a position radially farthest from the drive shaft 89, and the sleeve element 92 is axially slid on the drive shaft 89 toward the front side of the compressor to thereby turn the swash plate 93 to a position having a larger angle of inclination. Accordingly, the ellipsoidal locus of the sliding movement performed by the respective shoes 95 is made to lengthen the long diameter thereof, and the stroke of the respective pistons 94 is extended. Accordingly, the compression capacity of the compressor becomes large.

When the capacity control valve 97 is moved to a position preventing the fluid communication between the crank chamber 83 and the suction chamber 87 via the passageway 96, the pressure level in the crank chamber 83 is raised by a blow-by gas leaking from the cylinder bores 81 into the chamber 83, and thus the pressure acting as a back pressure against the pistons 94 is made high to reduce the angle of inclination of the swash plate 93 with respect to a plane perpendicular to the axis of the drive shaft 89. Accordingly, the hinge pin 93*b* of the hinge mechanism 91 is moved in the elongated aperture 91*a* to a position radially approaching the drive shaft 89, and the sleeve element 92 is slid on the drive shaft 89 toward the rear side of the compressor. Therefore, the swash plate 93 is turned toward an erect position thereof, and thus the ellipsoidal locus of the sliding movement performed by the respective shoes 95 is made to shorten the long diameter thereof, and the stroke of the respective pistons 94 is shortened. As a result, the compression capacity of the compressor becomes small.

With the above-mentioned reciprocation-drive mechanism of the pistons 94 of the variable capacity single-headed swash plate type compressor, since each of the shoes 95 is held in the spherical recess 94*a* of the piston 94, it is prevented from performing a random displacement. Nevertheless, as previously stated, the shoe 95 is permitted to slide on the front or rear face 93*d* or 93*c* of the swash plate 93 at the flat face 95*a* thereof along the ellipsoidal locus, and this ellipsoidal sliding movement of the shoe 95 results in a radial displacement thereof relative to the axis of the drive shaft 89 of the compressor. Therefore, when the compression of the refrigerant gas is performed by the piston 94 in the cylinder bore 81, and when the piston 94 receives a pressure of the compressed gas, the piston 94 transmits a corresponding force to the swash plate 93 via each shoe 95, which always includes an axial force component, and a radial force component transmitted in the radial direction with respect to the axis of the drive shaft 89 from the piston 94 to the swash plate 93 via the shoe 95. The extent of the latter radial force component changes depending on the angle of inclination of the swash plate 93, and due to the radial force from the piston 94 acting on the swash plate 93 via each shoe 95, the single headed piston 94 supported by the wall of the cylinder bore 81 at the cylindrical body portion thereof, but not supported at the frontmost portion thereof, comes into a tight contact with the wall of the cylinder bore 81 at a given portion thereof, and thus a local abrasion of the piston 94 and/or the wall of the cylinder bore 81 of the cylinder block 82 necessarily occurs, whereby a reliable long operation life of the compressor is prevented.

SUMMARY OF THE INVENTION

Therefore, an object of the present invention is to obviate the problem of the local abrasion encountered by the prior art variable capacity single headed piston-swash plate type compressor.

Another object of the present invention is to provide a variable capacity single-headed piston swash plate type refrigerant compressor provided with a novel motion conversion mechanism, i.e., a rotation-to-reciprocation conversion mechanism for pistons thereof.

In accordance with the present invention, there is provided a variable capacity single headed piston-swash plate type compressor provided with an axially extended cylinder block having front and rear ends thereof and a plurality of axial cylinder bores formed therein, a front housing connected to the front end of the cylinder block and defining a sealed crank chamber therein extending in front of the front end of the cylinder block, a rear housing connected to the rear end of the cylinder block and defining therein a suction chamber for a refrigerant gas before compression and a discharge chamber for the refrigerant gas after compression, a drive shaft rotatably held by the cylinder block and the front housing to have an axis thereof axially extended through the crank chamber, a rotary support mounted on the drive shaft to be rotated with the drive shaft in the crank chamber, a swash plate hinged to the rotary support to be rotated together with the drive shaft and slidably mounted on the drive shaft via a sleeve element to be slid in the axial direction of the drive shaft to be capable of turning about an axis perpendicular to the axis of the drive shaft, and a plurality of reciprocatory single headed pistons fitted in the cylinder bores of the cylinder block and engaged with the swash plate via a motion conversion means including spherical shoes for converting a rotation of the swash plate into a reciprocation of the single headed pistons in the cylinder bores, and a valve means for adjusting a fluid communication between the crank chamber and the suction chamber to control a capacity of the compressor through changing a pressure differential between the crank and suction chambers, wherein the motion converting means comprises means for preventing a local abrasion of at least the single headed pistons during reciprocating thereof in the cylinder bores. The local abrasion preventing means comprises first means for preventing a radial displacement of each of the spherical shoes at face thereof engaging the swash plate, and a second means for permitting a radial displacement of each of the shoes at a spherical face thereof engaged with the single headed piston.

Preferably, the first means comprises an annularly extended engaged portion formed in the swash plate, and an arcuate engaging portion formed in each of the spherical shoes and engaging the annularly extended engaged portion of the swash plate in manner such that each of the shoes is permitted to perform only a circumferential displacement thereof. The second means comprises a cylindrical support recess formed in the piston for supporting the spherical face of each of the shoes.

BRIEF DESCRIPTION OF THE DRAWINGS

The above and other objects, features and advantages of the present invention will be made more apparent from the ensuing description of the preferred embodiments thereof with reference to the accompanying drawings thereof wherein.

DESCRIPTION OF THE PREFERRED EMBODIMENTS

Figure 1:
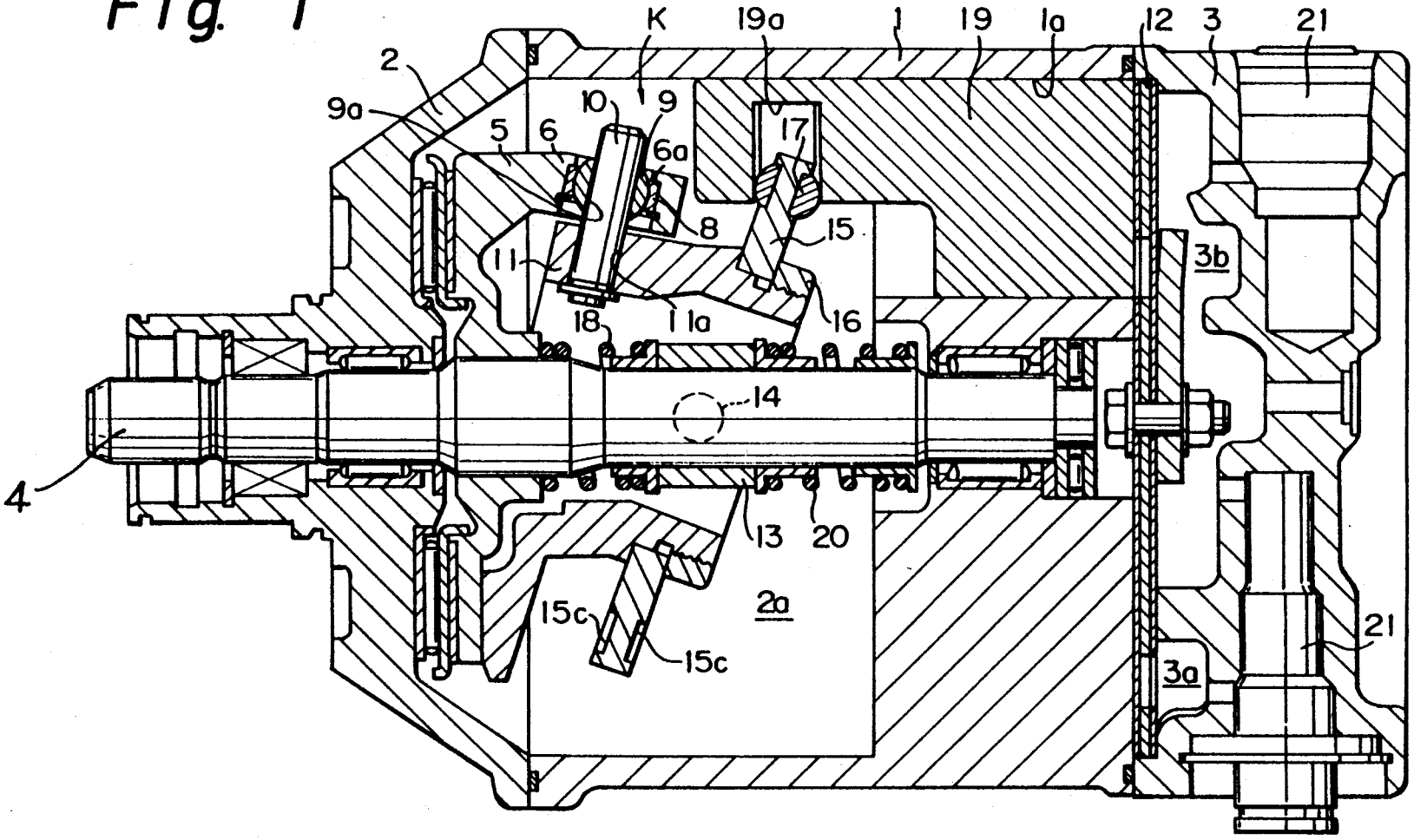
FIG. 1 is a longitudinal cross-sectional view of a variable capacity single headed piston-swash plate type compressor provided with a motion converting means incorporating therein a local piston-abrasion preventing means, according to a first embodiment of the present invention.

Referring to FIG. 1, a variable capacity, single headed piston, swash plate type refrigerant compressor has a cylinder block 1 having a plurality of cylinder bores 1*a*, and front and rear ends of the cylinder block 1 are sealingly closed by front and rear housings 2 and 3. The cylinder block 1 and the front housing 2 define an airtightly sealed cylindrical crank chamber 2*a* therebetween, for housing a later-described swash plate-operated compressing mechanism. A valve plate 12 is located between the rear end of the cylinder block 1 and the rear housing 3 having formed therein an annularly extending suction chamber 3*a* and a central discharge chamber 3*b* which can be communicated with the cylinder bores 1*a* of the cylinder block 1 via suction and discharge valve mechanisms, respectively. An axial drive shaft 4 is centrally arranged to extend through the front housing 2 and the cylinder block 1, and rotatably supported by bearings mounted in the front housing 2 and the cylinder block 1. A front end of the drive shaft 4 is outwardly extended from the front housing 2 to be connectable to a drive source such as a car engine, and a rear end thereof is rotatably supported by the bearing in the cylinder block 1.

A rotary support 5 is fixedly mounted on the drive shaft 4 in the crank chamber 2*a* to be rotatable with the drive shaft 4. The rotary support 5 is axially supported by a thrust bearing seated on an inner end of the front housing 2, and has an rearwardly extended support arm 6 for supporting a cylindrical rotary drive element 11 via a hinge mechanism generally designated by "K". Namely, the support arm 6 of the rotary support 5 has formed therein a through-hole 6*a* in which a race member 8 having a spherical socket for movably receiving a ball element 9 is tightly fitted. The race member 8 and the ball element 9 form a ball and socket joint, and the ball element 9 has formed therein a through-bore 9*a* in which is slidably engaged a guide pin 10 press-fitted in a through-bore 11*a* of the rotary element 11. The cylindrical rotary drive element 11 is extended toward an axially rear end of the crank chamber 2*a* to form an cylindrical mount on which a swash plate 15 of the swash plate-operated compression mechanism is mounted and tightly held by a threaded ring 16.

Figure 2:
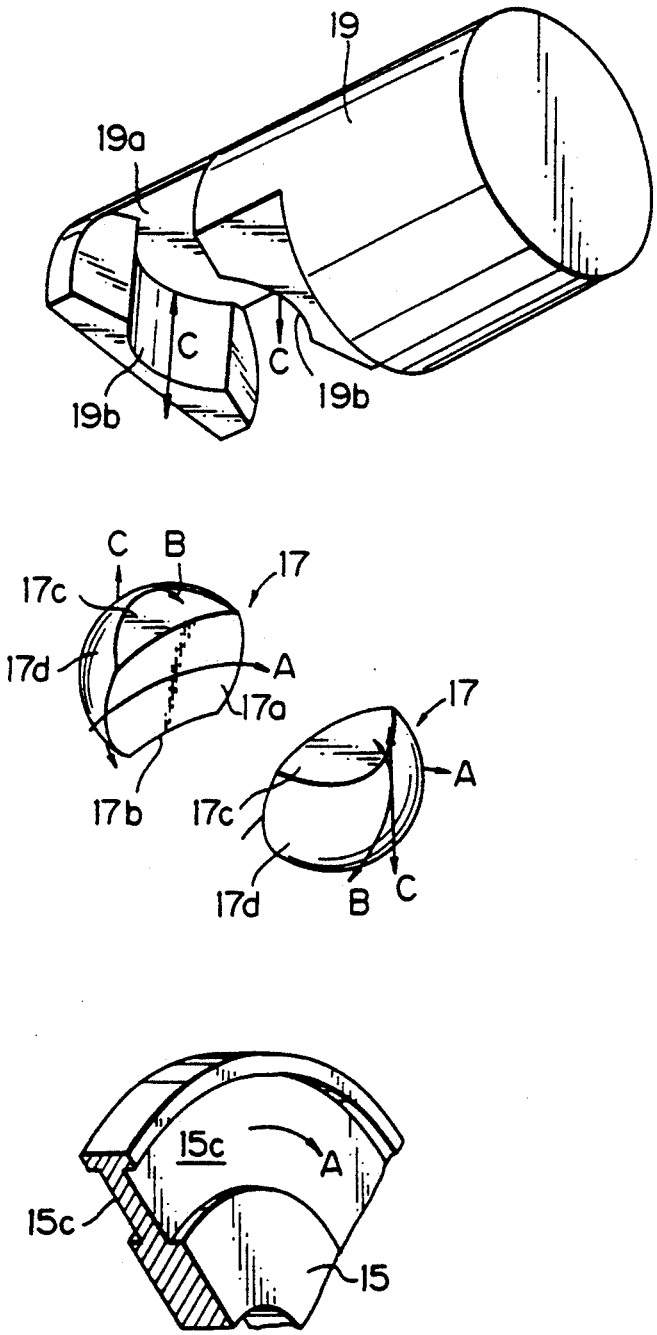
FIG. 2 is an exploded perspective view, on an enlarged scale, of the motion converting means of FIG. 1.

As best illustrated in FIG. 2, the swash plate 15 in the shape of a circular plate has formed in both faces thereof annularly extended engaged portions 15*c* recessed at the peripheral portion of the plate member to have the same diameter with regard to the center of the swash plate 15. The swash plate 15 is mounted on the drive element 11 in a manner such that the center of the swash plate 15 is positioned on the axis of the drive shaft 4. A pair of shoes 17 in the shape of a semi-sphere member is engaged in the annular engaged portions 15*c* to be displaceable in only a circumferential direction ( a direction shown by an arrow "A" in FIG. 2 ). Each of the pair of shoes 17 is provided with a flat face 17*a* to be kept in contact with an annular bottom of the engaged portion 15*c*, an inner arcuate side 17*b* to be kept in contact with an inner annular side wall of the engaged portion 15, and an outer arcuate side 17*c* to be in contact with an outer annular side wall of the engaged portion 15. The shoe 17 is also provided with a spherical face 17*d* on the back thereof. The pair of shoes 17 are arranged between the swash plate 15 and one of single-headed pistons 19 axially slidably fitted in the cylinder bores 1*a*. Each shoe 17 is engaged with the piston 19 to be moved in a direction indicated by an arrow "B", and displaced in a direction indicated by an arrow "C" in FIG. 2, relative to the piston 19. The single headed piston 19 includes a cylindrical body having a compressing head at an end thereof, and a neck portion axially extending from the opposite end of the cylindrical body and having formed therein a deep cutout 19*a* through which the swash plate 15 is rotated together with the rotary drive element 11. The neck portion of the piston 19 is provided with a pair of mutually confronting cylindrical support walls 19*b* between which the above-mentioned cutout 19*a* is defined. The confronting cylindrical walls 19*b* have the same radius of curvature as the spherical face 17*d* of the shoe 17 and are extended in a direction perpendicular to the axis of the piston 19, so that the pair of shoes 17 engaged in the annular engaged portions 15*c* of the swash plate 15 are turnably and displaceably held by the cylindrical walls within the cutout 19*a* of the piston 19. Therefore, the respective pistons 19 engaged with the swash plate 15 via corresponding pairs of shoes 17 are held in the respective cylinder bores 1*a*, to thereby implement a stable and smooth reciprocation in the cylinder bores 1*a*. Namely, the shoes 17 contribute to an accurate conversion of the rotation of the swash plate into the reciprocation of the single headed pistons 19.

In FIG. 1, the rotary drive element 11 is mounted around the drive shaft 4 via a slidable sleeve element 13. The sleeve element 13 is supported on the drive shaft 4 and subjected to axially opposite spring forces of a pair of springs 18 and 20 wound around the drive shaft 4. The sleeve element 13 is provided with a pair of lateral trunnion pins 14 fixed thereto and laterally projected to be engaged with the rotary drive element 11 at outer ends thereof. Therefore, the swash plate 15 mounted on the rotary drive element 11 is rotated with the drive shaft 4 about the axis of the shaft 4 via the rotary support 5 and the rotary drive element 11, and turned about the trunnion pins 14 via the hinge mechanism K and the slidable sleeve element 13 to thereby change an angle of inclination thereof with respect to a plane perpendicular to the axis of the drive shaft 4.

The compressor of FIG. 1 is further provided with two fluid control valves 21 mounted in the rear housing 3 to control a pressure level in the crank chamber 2*a*.

When the compressor is connected to a drive source, i.e., a car engine, the drive shaft 4 is rotated to thereby rotate the swash plate 15, and in turn, the single headed pistons 19 are reciprocated in the cylinder bores 1*a* by the above-described rotation-to-reciprocation conversion mechanism including the shoes 17. The refrigerant gas before compression is pumped from the suction chamber 3*a* of the rear housing 3 into the cylinder bores 1*a*, and the refrigerant gas after compression by the pistons 19 is delivered into the discharge chamber 3*b*.

During the compressing operation of the compressor, each of the shoes 17 of the rotation-to-reciprocation conversion mechanism is engaged with the swash plate 15 via the engagement of the flat face 17*a*, and the inner and outer arcuate sides 17*b* and 17*c* of the shoe 17 and the annular engaged portion 15*c* of the swash plate 15, so that the shoe 17 is permitted to move circumferentially relative to the rotating swash plate 15, as illustrated in FIG. 2. Nevertheless, the shoe 17 is prevented from being shifted in a radial direction of the swash plate 15 due to the above-mentioned engagement. The shoe 17 is, however, permitted to turn about the center of the spherical face 17*d* kept in line contact with the cylindrical support wall 19*b* of the piston 19 in the direction indicated by the arrows C in FIG. 2. Thus, the force acting on the piston 19 against the compression of the refrigerant gas is transmitted from the cylindrical support wall 19*b* of the piston 19 to the shoe 17, and in turn, transmitted to the swash plate 15. At this stage, since the engagement of the inner and outer arcuate sides 17*b* and 17*c* of the shoe 17 and the recessed engaged portion 15*c* of the single headed swash plate 15 does not allow any random play of the shoe 17 relative to the piston 19, and accordingly, the piston 19 is always maintained at an accurate axial posture to smoothly reciprocate in the axial cylinder bore 1*a*, a strong contact of a part of the piston 19 with the wall of the cylinder bore 1*a* does not occur. Accordingly, a local abrasion of the piston 19 and/or the wall of the cylinder bore 1*a* can be prevented.

When the swash plate 15 is turned about the trunnion pins 14 to change an angle of inclination thereof, each of the shoes 17 can be relatively displaced in the cutout 19*a* of the piston 19 (the direction of the arrow "C") while turning about the center thereof (the direction of the arrow "B") by the guide of the cylindrical wall 19*b* of the piston 19.

The compression capacity of the compressor, i.e., the entire amount of the refrigerant gas discharged from the cylinder bores 1*a* toward the discharge chamber 3*b* during one complete revolution of the drive shaft is adjustably changed by controlling the pressure level in the crank chamber 2*a* by the fluid control valves 21.

For example, when the control valves 21 are operated to establish a fluid communication between the crank chamber 2*a* and the suction chamber 3*a*, the back pressure acting on the respective pistons 19 is lowered to increase the angle of inclination of the swash plate 15 from the erect position thereof. Namely, the ball element 9 and the race member 8 of the hinge mechanism K are moved to turn the rotary drive element 11 about the trunnion pins 14 via the guide pin 10 in the clockwise direction in FIG. 1, and the sleeve element 13 is axially slid on the drive shaft 4 toward the front side of the compressor. Thus, the swash plate 15 is turned toward a position where an angle of inclination of the swash plate is large. During the turning of the swash plate 15 toward the large inclination angle position, each shoe 19 of the rotation-to-reciprocation conversion mechanism is gradually turned and displaced in the cutout 19*a* of the piston 19 under the guide of the cylindrical support wall 19*b* of the piston 19 to thereby permit a stable increase of the stroke of the piston 19.

To the contrary, when the capacity control valves 21 are operated to prevent a fluid communication between the crank chamber 2*a* and the suction chamber 3*a*, the pressure level in the crank chamber 2*a* is raised by a blow-by gas leaking from the respective cylinder bores la to thereby increase the back pressure action on the pistons 19. Thus, the swash plate 15 is turned toward a position where the angle of inclination of the swash plate 15 is smaller. Namely, the hinge mechanism K causes a turning of the rotary drive element 11 about the trunnion pins 14 in a counter clockwise direction in FIG. 1 and an, axial slide of the sleeve element 13 toward righthand direction in FIG. 1. Therefore, the swash plate 15 is turned toward the erect position thereof having the smallest inclination angle. Each shoe 17 is displaced and turned in the cutout 19*a* of the piston 19 by the guide of the cylindrical support wall 19*a* of the piston toward inside the cutout 19*a* to thereby permit a stable decrease of the stroke of the piston 19.

In the described embodiment of FIG. 1, the engaged portions 15*c* of the swash plate 15 are annular recesses easily formed by a machine tool, and each of the pair of shoes 17 can be identical mechanical elements. Accordingly, the motion conversion mechanism of the compressor can be produced at a rather low manufacturing cost.

Figure 3:
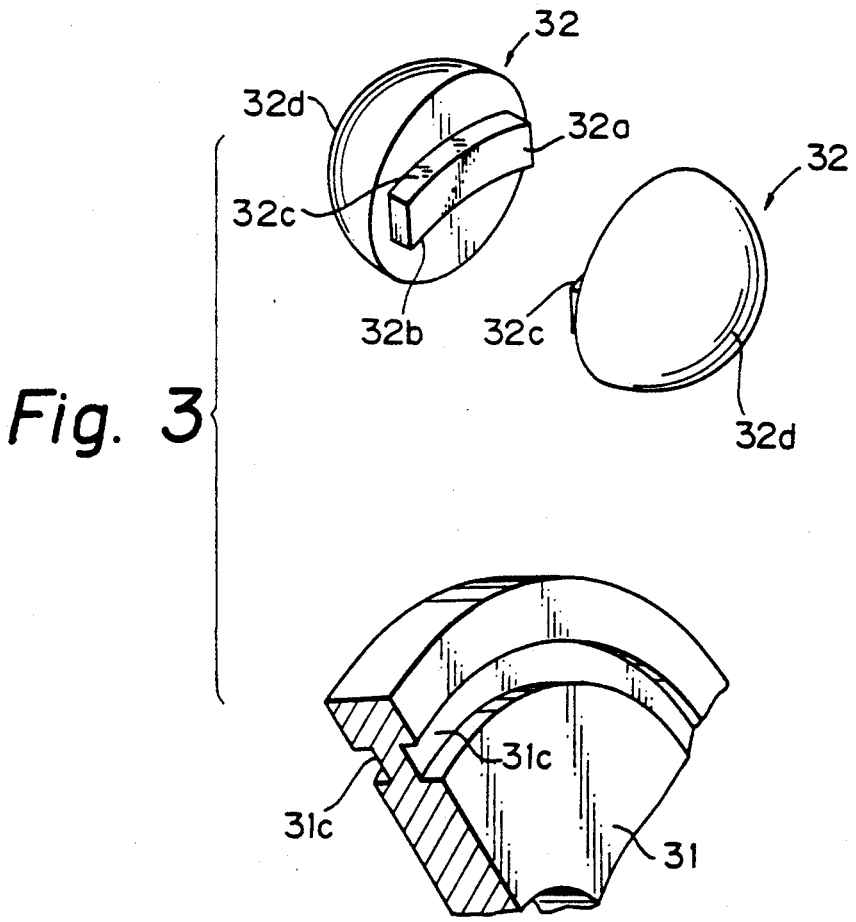
FIG. 3 is a similar exploded perspective view, on an enlarged scale, of the motion converting means according to a second embodiment of the present invention.

FIG. 3 illustrates a different motion conversion mechanism, i.e., a rotation-to-reciprocation conversion mechanism according to another embodiment of the present invention, which can be incorporated in a variable capacity single headed piston, swash plate type compressor. In FIG. 3, a swash plate 31 is substantially identical with the swash plate 15 of the first embodiment, and has a pair of engaged portions 31*c* in the shape of annularly extended recesses formed in the peripheral portion of the opposite faces of the swash plate 31. The engaged portions 31*c* of the swash plate 31 have a radial width narrower than those of the first embodiment.

Each of a pair of shoes 32 is provided with a projection engaged with the engaged portion 31*c* of the swash plate 31, and a spherical face 32*d* to be fitted in the cutout 19*a* of the piston 19 ( FIG. 1 ). The projection of the shoe 32 has a flat face 32*a* to be in contact with the bottom face of the engaged portion 31*c*, and inner and outer arcuate sides 32*b* and 32*c* to be in contact with inner and outer annular side walls of the engaged portion 31*c* of the swash plate 31, respectively.

The operation of the motion conversion mechanism, including the above-mentioned swash plate 31 and the shoes 32 is identical with that of FIG. 2 of the first embodiment, and therefore, a detailed description thereof is omitted.

Figure 4:
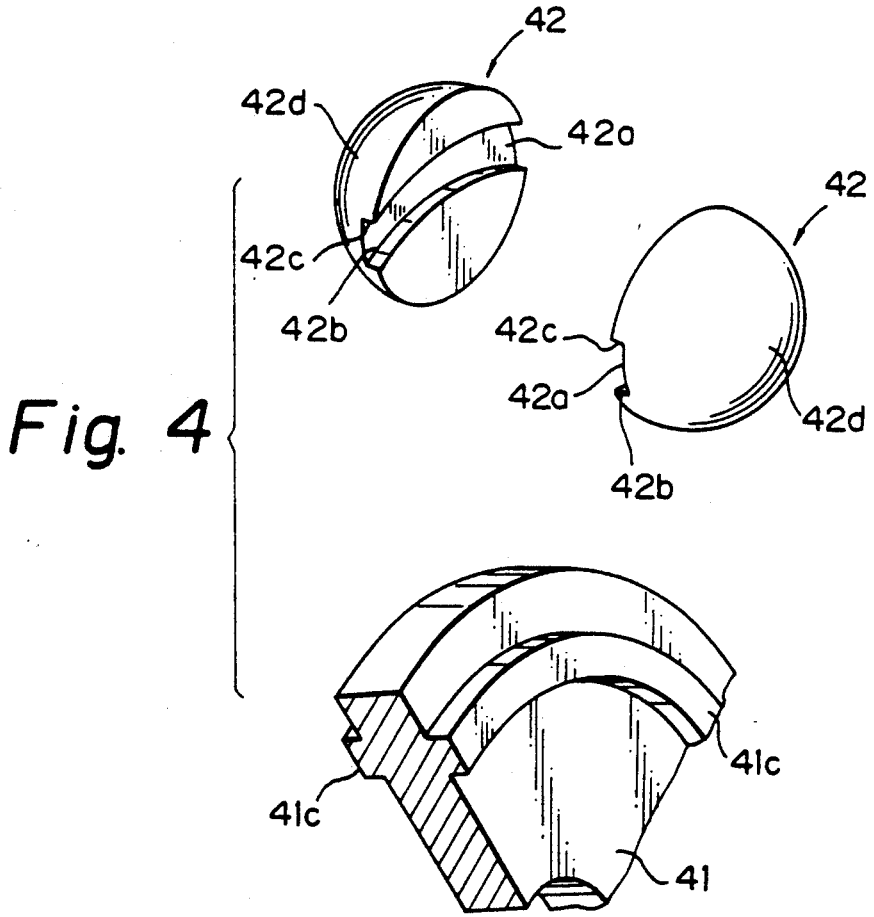
FIG. 4 is a similar exploded perspective view, on an enlarged scale, of the motion converting means according to a third embodiment of the present invention.

FIG. 4 illustrates a further different embodiment of a motion conversion mechanism, i.e., a rotation-to-reciprocation conversion mechanism able to be accommodated in a variable capacity single headed piston, swash plate type compressor. The motion conversion mechanism of FIG. 4 includes a swash plate 41 and a plurality of pairs of shoes 42 (only one pair of shoes is shown in FIG. 4 ) to be held between the swash plate 41 and respective pistons similar to those shown in FIG. 2. The swash plate 41 is provided with annularly extended engaged portions 41*c* on both faces thereof, to be engaged with a recess of each shoe 42. The recess of the shoe 42 has a annular flat face 42*a* to be in contact with an uppermost face of the engaged portion 41*c* of the swash plate 41, and inner and outer arcuate side walls 42*b* and 42*c* to be in contact with inner and outer sides of the engaged portion 41*c* of the swash plate 41. The shoe 42 is also provided with a spherical face 42*d* to be in contact with the cutout 19*a* of the piston 19 (FIG. 2) when assembled in the compressor. It will be easily understood that the operation and advantage of the motion conversion mechanism according to the embodiment of FIG. 4 is substantially the same as that of the embodiments of FIGS. 2 and 3. Namely, the motion conversion mechanism of FIG. 4 can effectively prevent a local abrasion of the single headed reciprocatory pistons 19 of the variable capacity swash plate type refrigerant compressor, and accordingly, can contribute to a long operation life of the compressor per se.

Figure 5:
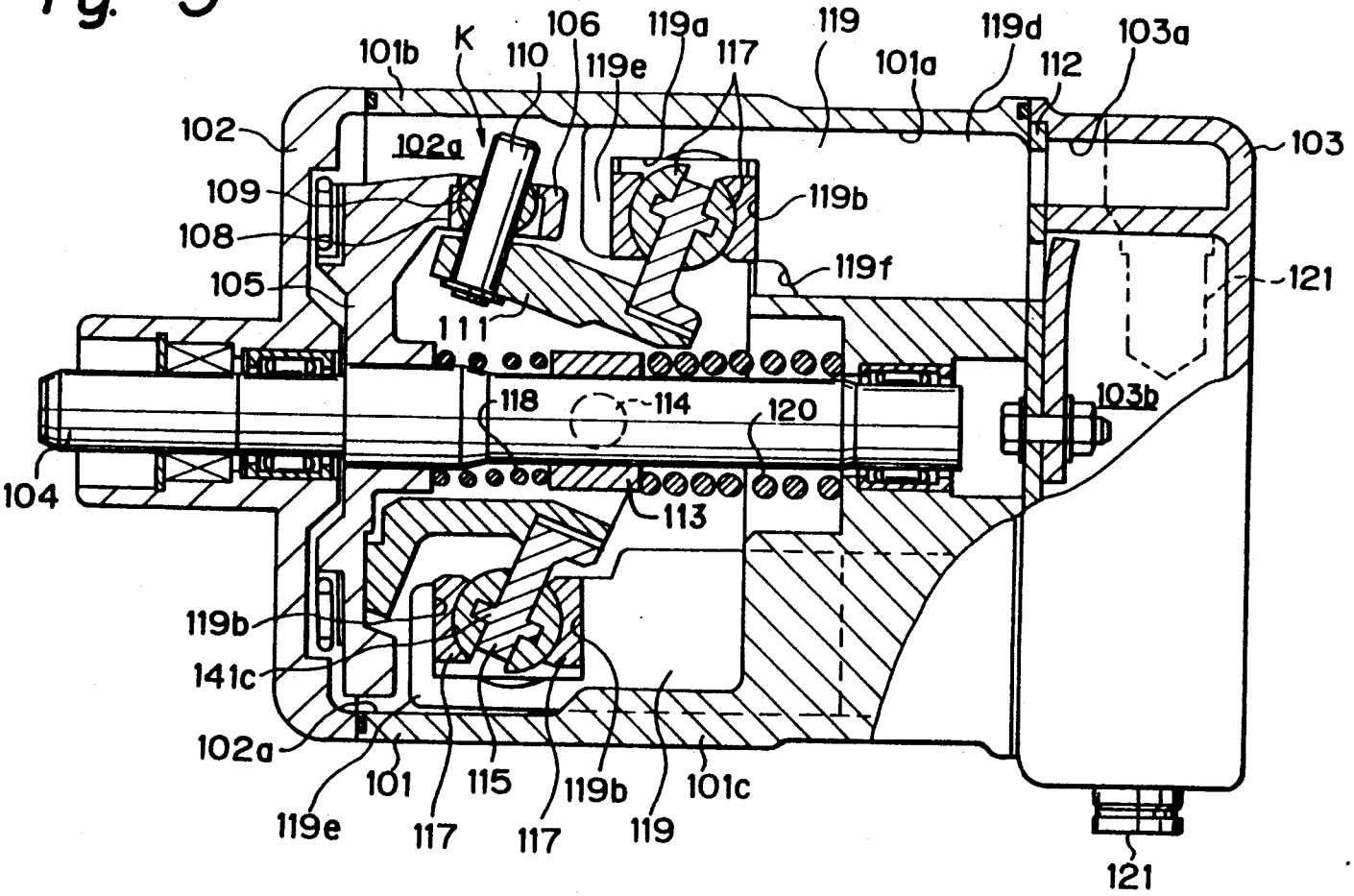
FIG. 5 is a longitudinal cross-sectional view of a variable capacity single headed piston-swash plate type compressor provided with a motion converting menas incorporating therein a local piston-abrasion preventing means, according to a fourth embodiment of the present invention.

FIG. 5 illustrates a variable capacity single headed piston, swash plate type compressor according to a further embodiment of the present invention. Although the external appearance of the compressor of this embodiment is slightly different from that of FIG. 1, the basic internal construction and the operation of the compressor of FIG. 5 is identical with those of the compressor of FIG. 1. Therefore, elements of the compressor of FIG. 5 identical with or the same as those of the compressor of FIG. 1 are designated by reference numerals corresponding to the reference numerals of FIG. 1, plus "100".

Figure 6:
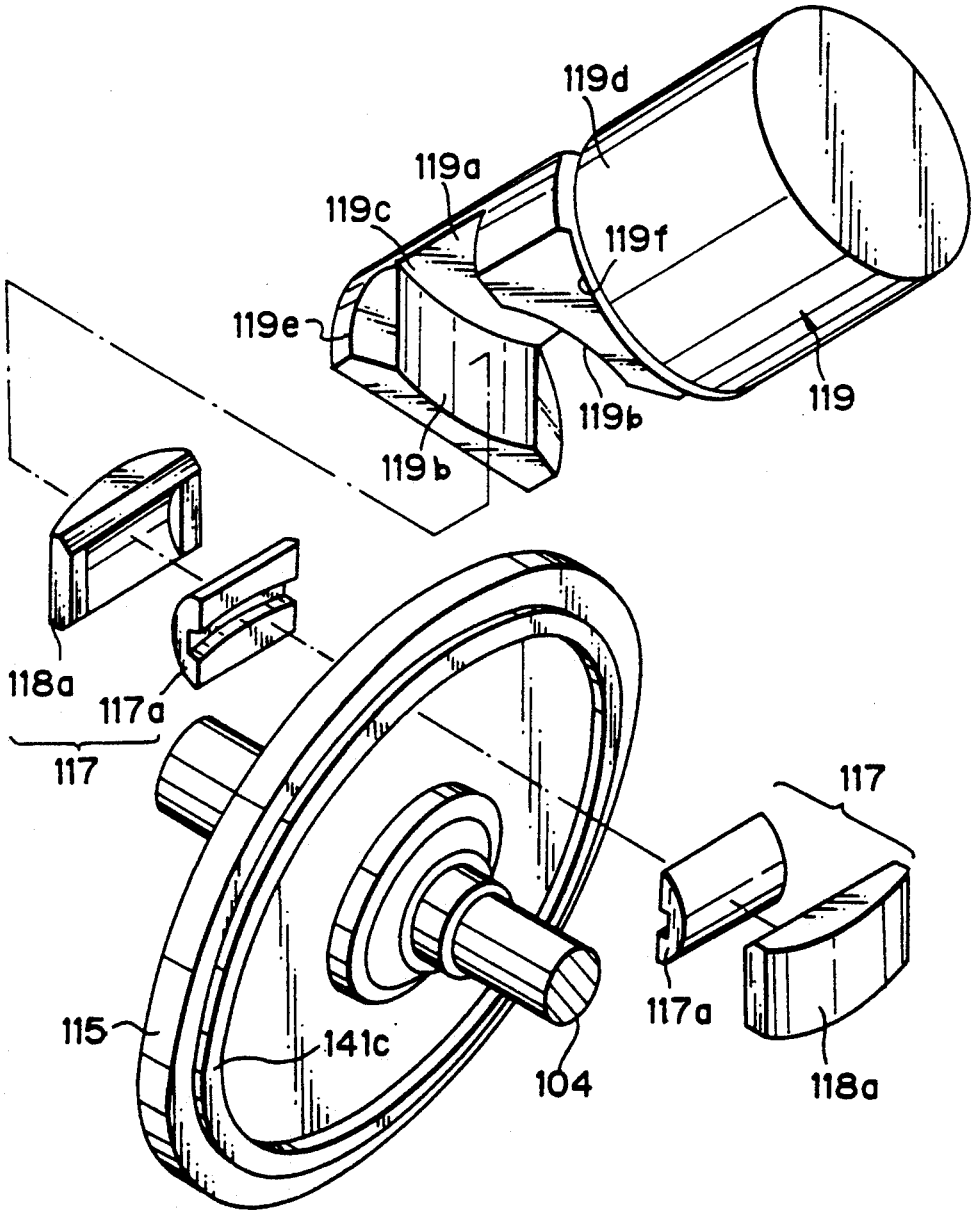
FIG. 6 is an exploded perspective view, on an enlarged scale, of the motion converting means of FIG. 5.

In the compressor of FIG. 5, a plurality of pistons 119 slidably fitted in cylinder bores 101*a* of a cylinder block 101 are reciprocated by a rotation-to-reciprocation mechanism arranged in an airtightly closed crank chamber 102*a* of the cylinder block 101, and including a plurality of pairs of shoes 117 intervened between a swash plate 115 mounted on a rotary drive element 111 and the respective pistons 119 as typically shown in FIG. 6. The rotation of the swash plate 115 is driven by a drive shaft 104 via a rotary support element 105 and the rotary drive element 111, and a turning of the swash plate 115 about trunnion pins 114 is caused by a change in a pressure level in the crank chamber 102*a*, which pressure level is adjustably controlled by a pair of flow control valves 121. A hinge mechanism K including a ball element 109, a race element 108, and a guide pin 110 is provided in the crank chamber 102*a* for permitting the turning of the rotary drive element 111 and the swash plate 115. A rear housing 103 has formed therein a suction chamber 103*a* for a refrigerant gas before compression, and a discharge chamber 103*b* for the refrigerant gas after compression, and these chambers 103*a* and 103*b* are communicatable with the cylinder bores 101*a* of the cylinder block 101.

Figure 7:
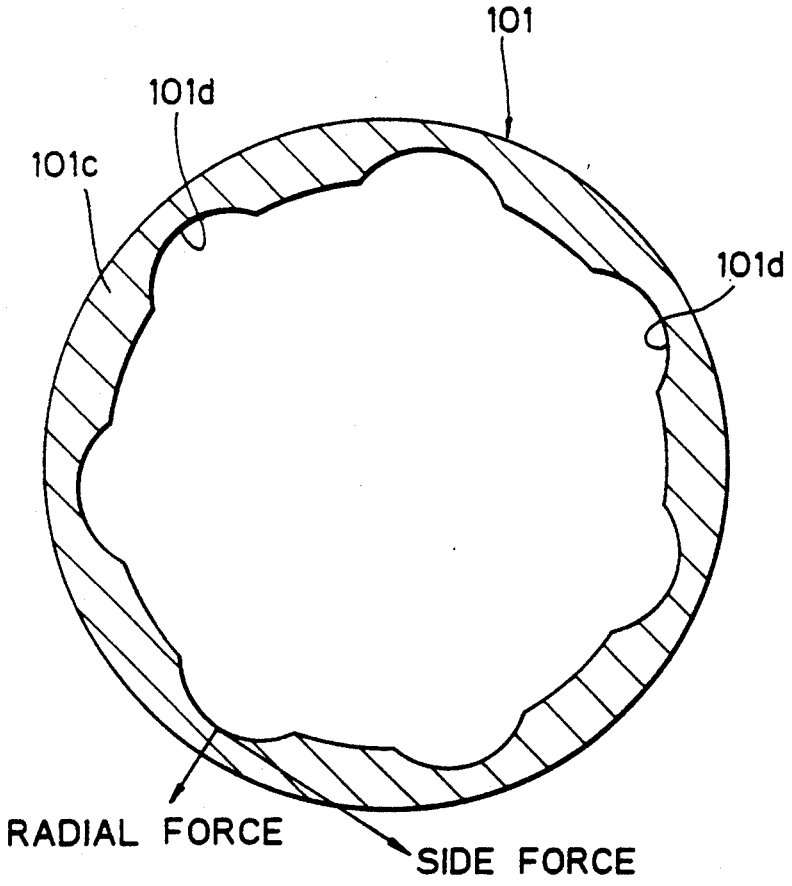
FIG. 7 is a cross-section taken along the line VII—VII of FIG. 5.
Figure 8:
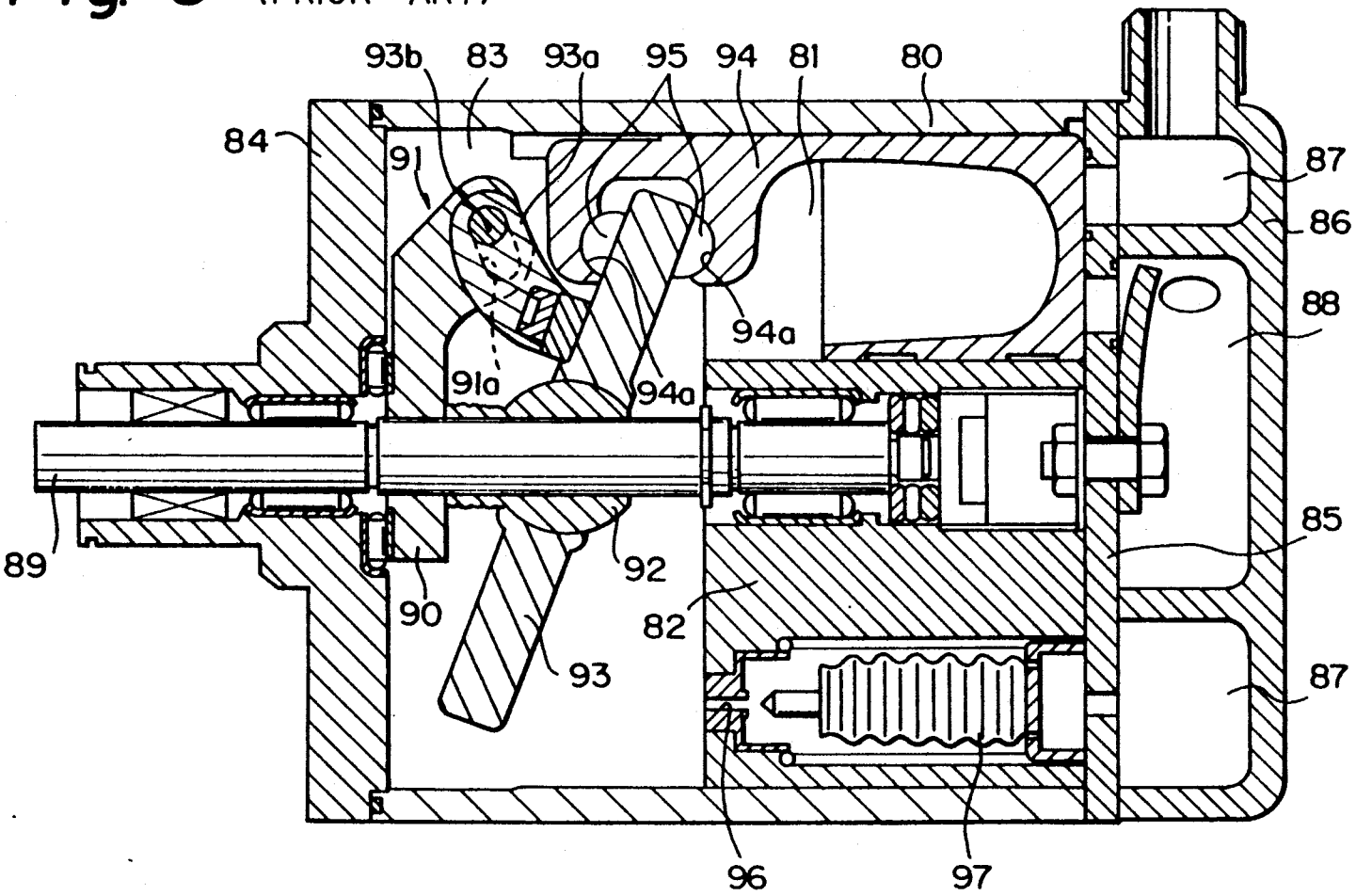
Fig. 8 (PRIOR ART)
FIG. 8 is a longitudinal cross-sectional view of a variable capacity single headed piston-swash plate type compressor according to the prior art; and, FIG. 9 is a partial perspective view of the motion converting means of the compressor of FIG. 8.
Figure 9:
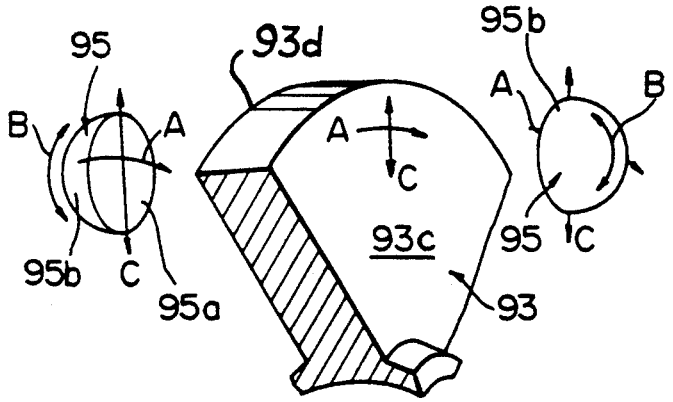
Fig. 9 (PRIOR ART)

A description of the characteristic construction and operation of the compressor of FIG. 5 will be further provided below with reference with FIGS. 6 and 7 in addition to FIG. 5.

As best illustrated in FIG. 6, each of the single headed pistons 119 is provided with an axial neck portion 119*e* and a cylindrical head portion 119*d* integral with the neck portion 119*e*. A back face 119*f* is a boundary portion of the neck and head portions 119*e* and 119*d*. The neck portion 119*e* of the piston 119 has a partial cylindrical surface radially remote from the drive shaft 104, and a cutout 119*a* radially opening toward the drive shaft 104. The partial cylindrical surface of the neck portion 119*e* has the same diameter as that of the head portion 119*d* of the piston 119, and accordingly the partial cylindrical surface is formed as an extension of the head portion 119*d* of the piston. The cutout 119*a* of the neck portion 119*e* has a bottom face 119*c* and a pair of confronting cylindrical support walls 119*b* to permit passage of the swash plate 115 during the rotation of the swash plate 115 and to hold a pair of shoes 117 operative to convert the rotation of the swash plate 115 into the reciprocation of the piston 119 in the cylinder bore 101*a*. Each of the pair of shoes 117 includes an outer shoe element 118*a* slidably and turnably fitted in the cylindrical support wall 119*b*, and an inner shoe element 117*a* received by the outer shoe element 118*a* and having an arcuate groove slidably engaged with one of annularly extended engaged portions 141*c* of the swash plate 115. Namely, the rotation-to-reciprocation mechanism of FIG. 6 has substantially the same construction as that of the afore-described embodiment of FIG. 4. Thus, the rotation-to-reciprocation mechanism of FIG. 6 can provide the respective pistons 119 with an accurate and stable support to perform an axial reciprocation in the cylinder bore 101*a* without permitting any radial play of the pistons 119. Accordingly, the respective pistons 119 can continue a smooth reciprocation to compress a refrigerant gas for a long operation life of the compressor without causing a local abrasion thereof and of the wall of the cylinder bore 101*a*.

Further, in the compressor of FIG. 5, the cylinder block 101 has a thin cylindrical wall portion 101*b* at a front side thereof, and a thick cylindrical wall portion 101*c* at a central portion thereof. The thick cylindrical wall portion 101*c* of the cylinder block 101 has formed in an inner cylindrical surface thereof a plurality of partly circular recesses 101*d* extended axially from the respective cylinder bores 101*a*. FIG. 7 illustrates a cross-section of the cylinder block 101, clearly showing the shape of the plurality of equiangularly arranged partly circular recesses 101*d*, e.g., seven recesses 101*d* in the present embodiment for the compressor incorporating therein seven single headed pistons 119. These partly circular recesses 101*d* are provided for presenting the neck portions 119*e* of the respective single headed pistons 119 with an axial guide during the reciprocation of the pistons. Namely, the partly circular recesses 101*d* can prevent random play of the pistons 119 when they are subjected to a non-axial force such as a radial force or side force, as indicated in FIG. 7, during the operation of the rotation-to-reciprocation conversion mechanism. As a result, the respective single headed pistons 119 will always perform an accurate axial reciprocation in the cylinder bores 101*a*, and thus a local abrasion thereof can be prevented. A local abrasion of the wall of the cylinder bores 101*a* can be also prevented. The axial length of the part circular recesses 101*d* of the cylinder block 101 preferably should be sufficient for presenting an axial guide to at least a part of the neck portions 119*e* of the respective pistons 119 even when each piston is slid to the bottom dead center thereof under a condition where the swash plate 115 is turned toward the largest inclination angle position.

From the foregoing description of the preferred embodiments of the present invention it will be understood that, according to the present invention, a local abrasion of the single headed pistons incorporated in a variable capacity swash plate type refrigerant compressor can be effectively prevented during the reciprocation thereof, and accordingly, a long operation life of the single headed pistons and the compressor per se can be obtained.

We claim:

1. A variable capacity single headed piston, swash plate type refrigerant compressor comprising:

an axially extending cylinder block having front and rear ends thereof and a plurality of axial cylinder bores formed therein with front ends at said front end of said cylinder block;

a front housing sealingly connected to said front end of said cylinder block and defining a closed crank chamber therein extending in front of said front ends of said cylinder bores;

a rear housing connected to the rear end of said cylinder block and defining therein both a suction chamber for a refrigerant gas before compression and a discharge chamber for said refrigerant gas after compression;

a drive shaft rotatably supported by said cylinder block and said front housing with its axis axially extended through said crank chamber;

a rotary support element mounted on said drive shaft to be rotated therewith in said crank chamber;

a swash plate hinged to said rotary support element to be rotated together with said drive shaft, and mounted around said drive shaft via a slidable sleeve element to be turnable about a lateral axis perpendicular to the axis of said drive shaft;

a plurality of single headed reciprocatory pistons reciprocatively fitted in said cylinder bores of said cylinder block, and engaged with said swash plate via a motion conversion means including a plurality of pairs of spherical shoes each shoe of which is in annular slidable contact with said swash plate for converting rotation of said swash plate into reciprocation of each of said respective single headed pistons in said cylinder bores; and control valve means for controlling fluid communication between said crank chamber and said suction chamber to thereby control compressor capacity by changing the pressure differential between said crank and suction chambers, wherein said motion conversion means comprises menas for preventing local abrasion of at least said single headed pistons during reciprocation thereof in said cylinder bores, said means for preventing the local abrasion of at least said single headed pistons comprising:

first mears for preventing radial displacement of each of said spherical shoes relative to said swash plate during the rotation thereof; and second means for permitting radial displacement and rotation of each of said pair of shoes about its respective center relative to each of said pistons during controlling of compressor capacity by said control valve means.

2. A variable capacity single headed piston, swash plate type refrigerant compressor according to claim 1, wherein said first means of said means for preventing the local abrasion of at least said single headed pistons comprises:

an annularly extended engaged portion formed in said swash plate; and an arcuate engaging portion formed in a first portion of each of said spherical shoes and engaged with said annularly extended engaged portion of said swash plate in manner such that each of said shoes is permitted to perform only a circumferential displacement thereof, and wherein said second means of said means for preventing the local abrasion of at least said single headed pistons comprises;

a recess formed in a neck portion of each said piston to be extended radially with respect to an axis of each said piston, and having a pair of confronting cylindrical support walls for permitting a second spherically formed portion of each of said pair of shoes to be in slidable and turnable contact with one of said pair of cylindrical support walls of said recess of each said single headed piston.

3. A variable capacity single headed piston, swash plate type refrigerant compressor according to claim 2, wherein said annularly extended engaged portion formed in said swash plate comprises annularly extended recesses formed in opposite faces of said swash plate at a peripheral portion thereof, and said arcuate engaging portion formed in said first portion of each of said pair of spherical shoes comprises a flat face to be in contact with a bottom face of one of said annularly extended recesses of said swash plate, and inner and outer arcuate sides to be in contact with inner and outer walls of one of said annularly extended recesses of said swash plate.

4. A variable capacity single headed piston, swash plate type refrigerant compressor according to claim 2, wherein said annularly extended engaged portion formed in said swash plate comprises annularly extended projections formed in opposite faces of said swash plate at a peripheral portion thereof, and said arcuate engaging portion formed in said first portion of each of said pair of spherical shoes comprises an annularly extended recess in which one of said annularly extended projections of said swash plate is relatively circumferentially slidably fitted.

5. A variable capacity single headed piston, swash plate type refrigerant compressor according to claim 2, wherein said pair of confronting cylindrical support walls of said recess formed in said neck portion of each said piston has the same radius of curvature as that of said second spherical portion of said each shoe.

6. A variable capacity single headed piston, swash plate type refrigerant compressor according to claim 1, wherein said means for preventing the local abrasion of at least said single headed pistons further comprises a plurality of partly circular guide recesses axially formed in an inner wall of said cylinder block defining said crank chamber in a manner such that each of said partly circular guide recesses comprises an axial extension from each of said plurality of cylinder bores, said plurality of partly circular guide recesses providing an axial support for said plurality of single headed pistons during the reciprocation thereof.

* * * * *